United States Patent [19]

Fischer et al.

[11] 3,980,030

[45] Sept. 14, 1976

[54] DEVICE FOR PRODUCING PIPED OPENINGS IN GARMENT PARTS

[76] Inventors: Jochen Fischer, Grieses Hof 5, 4812 Brackwede; Reinhold Schrudde, Birkenstr. 77, 4801 Milse, both of Germany

[22] Filed: Dec. 16, 1974

[21] Appl. No.: 533,151

[52] U.S. Cl. ..... 112/121.15; 112/65

[51] Int. Cl.[2] ..... D05B 3/10

[58] Field of Search ..... 112/121.15, 65, 68, 112/70, 76, 264, 155, 147, 121.11

[56] References Cited

UNITED STATES PATENTS

| | | | |
|---|---|---|---|
| 1,477,142 | 12/1923 | McCann | 112/76 |
| 2,529,072 | 11/1950 | Bradford et al. | 112/68 |
| 2,573,359 | 10/1951 | Rich | 112/65 |
| 3,653,345 | 4/1972 | Bianchi | 112/65 |
| 3,747,545 | 7/1973 | Nicolay et al. | 112/68 |

*Primary Examiner*—Werner H. Schroeder
*Assistant Examiner*—Peter Nerbun

[57] ABSTRACT

A device for producing piped openings in flat base material, for instance welted pockets, comprising first workpiece clamping means for securing a workpiece to a workplate, piping patch holding and folding means, sewing machines for sewing said folded piping patch on said workpiece with two stitch rows cutting means for cutting a slit and V-shaped tab slits at the ends of said slit, and a second workpiece clamping means which is displacable into said first workpiece clamping means and said piping patch holding and folding means, to receive said flat base material together with said folded piping patch and to feed them through said sewing machines and said cutting means.

12 Claims, 20 Drawing Figures

XVIII
XVIII

DEVICE FOR PRODUCING PIPED OPENINGS IN GARMENT PARTS

BACKGROUND OF THE INVENTION

This invention relates to a device for producing piped openings in skirts, trousers and the like flat base material.

The operations for making piped openings or piped buttonholes by means of fully automatic machines are described in U.S. Pat. Nos. 3,529,072 and 3,653,345 and can be described as follows:

The operator places the base material on a workplate below a work clamp and positions a piping patch thereon. After starting the device the workplate is actuated together with the work clamp and the folding means for moving along the longitudinal axis of the sewing machine under a pair of needles to form two rows of stitches and a slit between the stitch rows. After this, the machine stops and two cuts having the shape of a V will be made at the ends of the slit.

During the time between the beginning of sewing and the returning of the workpiece clamp and the folding means into their start position, the operator is substantially inactive, aside from the time used for seizing the next following garment parts and the associated piping patch.

It is an object of the invention to create a device which divides up the necessary working steps of producing piped openings in garment parts in such a manner that the operator can do all preparing steps for handling the next following garment parts whilst one garment part is processed, in order to obtain an excess of output.

According to the invention this problem is solved by providing a device comprising a workpiece clamp and a folding device which are stationarily arranged in front of the sewing device. The workpiece clamp consists of a first workpiece clamp cooperating with the folding device, and a second workpiece clamp, which is capable to be displaced into the first workpiece clamp and the folding device, in order to receive the workpiece cuts positioned therein, and to feed them to the sewing machine and the cutting devices. The second workpiece clamp is provided with two pairs of clamping rails which can be lowered independently from each other upon the piping patch.

Further features of the invention will be apparent from the following specification and the drawings.

DESCRIPTION OF THE PREFERRED EMBODIMENT

Figure 2:
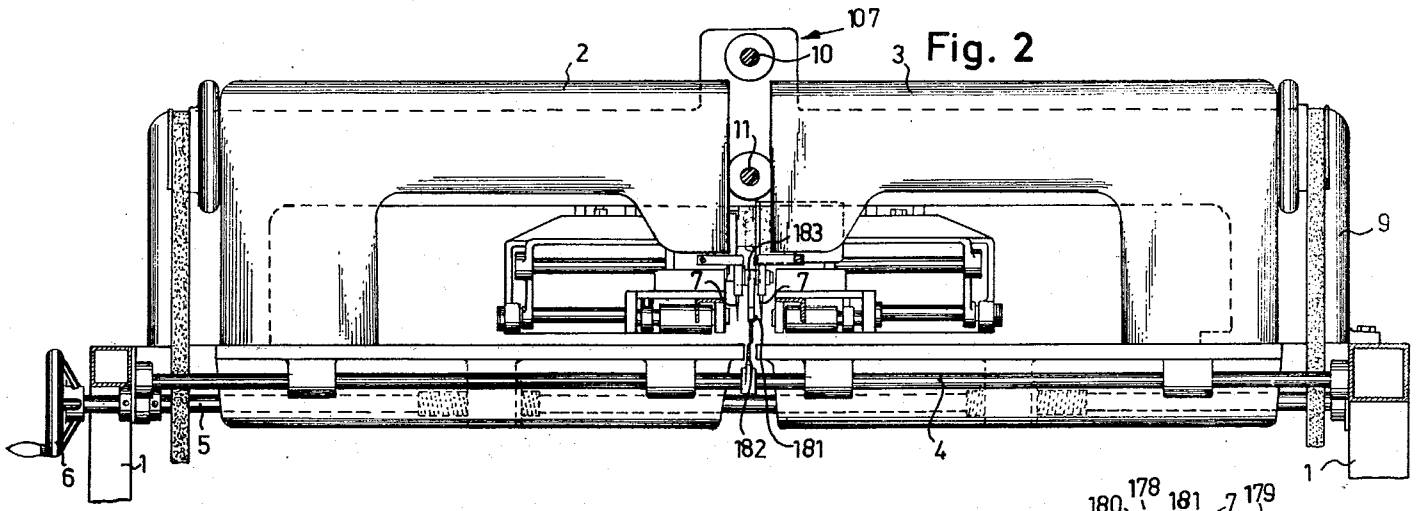
FIG. 2 is a front sectional elevation view of the device taken along line II—II of FIG. 1, in an enlarged scale.

Within a cutout of the workplate carried by the frame 1, there are arranged two sewing machines 2, 3 in a head-to head position. The sewing machines 2, 3 are supported upon a rod 4 mounted to the frame 1, and a threaded spindle and are adjustable in opposite direction with respect to the distance of the sewing machine needles 7 by means of a handwheel 6 and the threaded spindle 5.

Screwed to the frame 1 are two bridge-like carriers 8, 9 supporting two carrying rods 10, 11, to the free ends of which is displacably and clampably arranged a stationary supporting body 12. The latter carries a first workpiece clamp 13 (FIGS. 1 and 6) and folding device 14 (FIGS. 1 and 9 to 12) for the piping patch 15.

Figures 4, 5, 6:
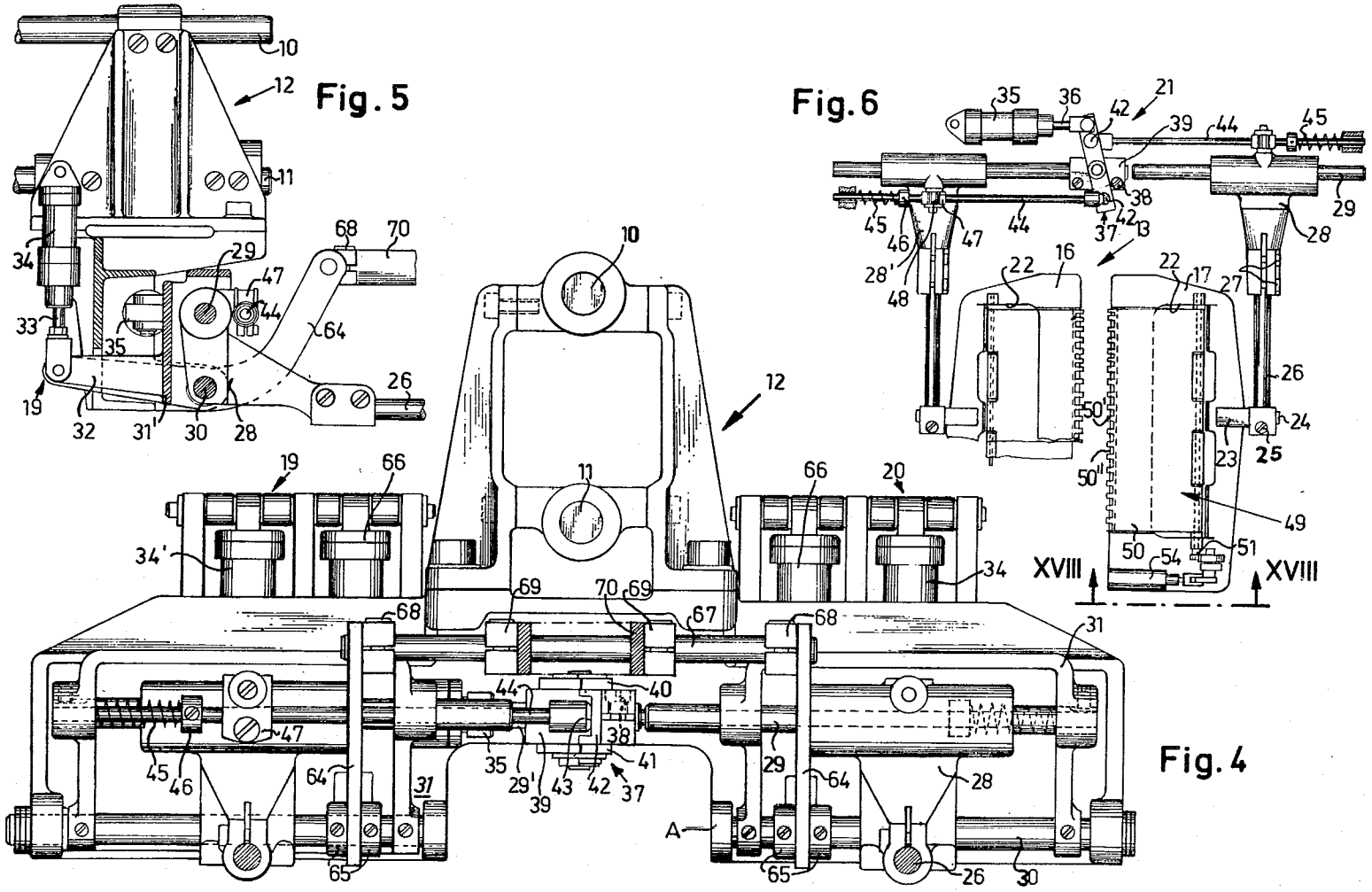
FIG. 4 is a sectional view taken along line IV—IV of FIG. 1 showing a stationary supporting body carrying the first workpiece clamp means, in an enlarged scale.
FIG. 5 is a side elevation view of the stationary supporting body shown in FIG. 4.
FIG. 6 is a top plan view of the first workpiece clamp with the clamping plates and the parts for the motion drive.

The first workpiece clamp 13 is provided with two clamping plates 16, 17 (FIGS. 6, 10 and 11) for the workpiece 18. The clamping plates 16, 17 supported at the supporting body 12, are liftable independently from each other by means of lifting devices 19, 20, and displacable in parallel and in an opposite direction by means of a displacing device 21. The clamping plates 16, 17 are formed with a recess 2 (FIG. 6) and provided with a block 23 having a pivot 24. The pivot 24 is pivoted and clampably secured to an arm 26 by means of a clamping screw 25. The arm 26 is axial displacably carried by a displacing block, 28 (FIGS. 4 to 6) by means of clamping screws 27. The block 28 is displacably supported on a rod 29 and a shaft 30, both secured to a swivelling frame 31. The shaft 30 is pivoted in the supporting body 12. The swivelling frame 31 is provided with an arm 32 (FIG. 5) to which is hinged a piston rod 33 of a compressed air cylinder 34 (FIGS. 4 and 5).

Supported to the swiveling frame 31' connected with the clamping plate 16, is a compressed air cylinder 35, the piston rod 36 of which engages a double-armed lever 37 pivoted on a block 39 secured to the rod 29' by means of clamping screws 38. The double-armed lever 37 comprises an upper plate 40 and a lower plate 41, which are connected by means of two rotatable bolts 42. The bolts 42 are formed with a flattening 43 to which abuts the end of a displacing rod 44 under the tension of a pressure spring 45 arranged upon the rod 44 between an adjusting ring 46 and a side wall of the swivelling frame 31, 31'. Clamped to the displacable rods 44 are forked engaging pieces 47 engaging in the lugs 48 of the displacing blocks 28.

Figure 18:
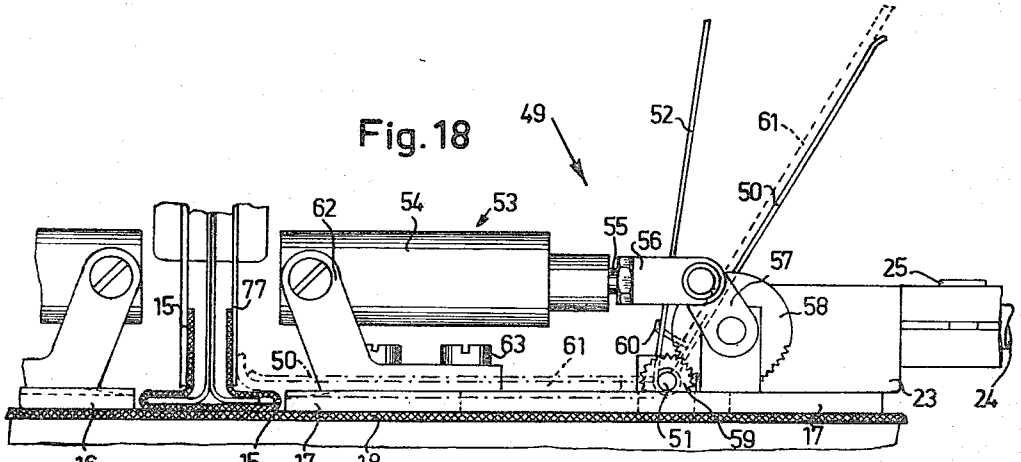
FIG. 18 is a front elevation view of a flap feeding device taken along line XVIII—XVIII of FIG. 6.

Each clamping plate 16, 17 carries a flap feeding device 49 (FIGS. 6 and 18) comprising an upper comb-like flap clamping plate 50 secured to a shaft 51 pivoted to the clamping plate 52 pivoted about the shaft 51, and a driving motor 53 in the shape of a compressed air cylinder 54, the piston rod 55 of which drives by means of a forked piece 56 and a crank 57 a toothed wheel 58 meshing with a toothed wheel 59 secured to the shaft 51. Arranged at the upper flap clamping plate 5o is a driver 60 (FIG. 18) driving the lower flap clamping plate 52 when the upper plate 50 is swung into the drawn position for inserting a pocket flap 61. The compressed air cylinder 54 is swingably supported in a bearing block 62 secured to the clamping plate 16 resp. 17 by means of screws 63.

Liftably arranged to the stationary supporting body 12 (FIGS. 4 and 5) is the folding device 14 for the piping patches 15 (FIGS. 9 to 12). For this purpose, two double-armed levers 64 are pivoted between adjusting rings 65 on the shafts 30. Only one arm of each lever 64 is hinged to the piston rod of the compressed air cylinder 66, while the free arms of the levers 64 are connected by means of a rod 67 which is secured to the levers 64 by means of clamping screws 68. Displacably and clampably arranged on the rod 67 by means of clamping parts 69 is an U-shaped bracket 70 (FIGS. 4 and 9) carrying the folding device 14. The carrier 71 of the folding device 14 (FIGS. 9, 10 and 12) is provided with a clamping member 72 serving for securing the carrier 71 to a rod 73, which is fixedly connected to the U-shaped bracket 70. In the carrier 71 are pivoted two shafts 74, 75, to the ends of which are secured levers 76. Screwed to the latter are two folders 77, 78 for the piping patch 15. Furthermore, two levers 79, 80 are clamped to each shaft 74, 75. The levers 79, 80 are connected by means of a rod 81 to which engages a piston 82 of a compressed air cylinder 83 and a tension spring 84 (FIGS. 9 and 10) moving the folders 77 into the position dot-lined in FIG. 10 when the cylinder 83 is not pressurized. When the compressed cylinder 83 is pressurized, the adjusting screws 86 abut against a plate 88 provided with recesses 87 and screwed to the carrier 71.

Arranged at the plate 88 are two center rails 89, 90 which are displacable in parallel to each other and angled at the bottom. The center rails 89, 90 are secured to two support bars 91, 92 which are formed with offsets 93 located in the recesses 87. The offsets 93 are provided with recesses 94 through which project lower parallel guides 95, 96 (FIGS. 9, 10) hinged together with upper parallel guides 97, 98 to the plate 88 resp. to the offsets 93 of the support bars 91 by means of bolts 99, 100. Pivoted to the bolt 100 is a lever 101, the free end of which is hingably connected to the parallel guides 102, 103 (FIGS. 9 and 12) cooperating with the center rail 89. In the middle of the lever 101 is hinged at 105 a piston rod 104 of an aircylinder 106 accomodated in the carrier 71. If pressurized, the air cylinder 106 displaces the parallel guides 98, 102 by means of the lever 101, so that the center rails 89, 90 are moved from the position shown in FIGS. 9, 10 and 12, into the position shown in FIG. 11.

Figure 1:
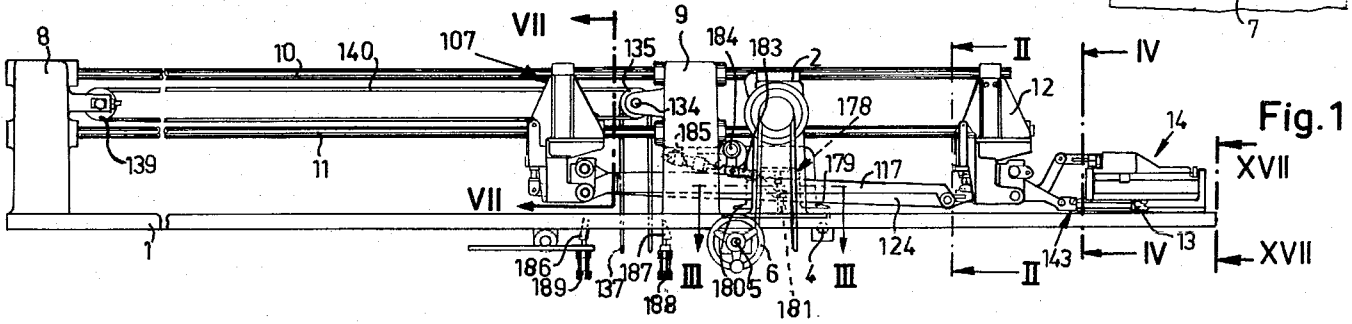
FIG. 1 is a side elevation view showing the sewing device according to the invention.

As obvious from FIG. 1, a supporting body 107 is displacably supported on the parts of the carrying rods 10 and 11 located between the carriers 8 and 9. This supporting body 107 represented in FIGS. 7 and 8 in an enlarged scale, is nearly similar to the stationary supporting body 12 and is formed with two swivelling frames 108, 109 having an arm 110. Engaging with the arm 110 is a rod 111 adjustable in length and the other end of which is supporting at an axis 112 located at the supporting body 107.

The swivelling frames 108, 109 are secured to shafts 113 by means of screws 114. The shafts 113 are pivoted in bearing eyes 115 of the supporting body 107. Secured to the ends of rods 116 and the shafts 113 projecting from the swivelling frames 108, 109 are two homologously formed jibs 117, 118, which are forked at the free end (FIGS. 8a and 7) and provided with bearing eyes 119, 120 for receiving an axis 121. On the axis 121 are pivoted double-armed levers 122, 123, one arm 124 of which is extending to the swivelling frame 109 resp. 108, while extension arms 127, 128 are secured to the other shorter arm 125 resp. 126.

Figures 7, 8, 8A:
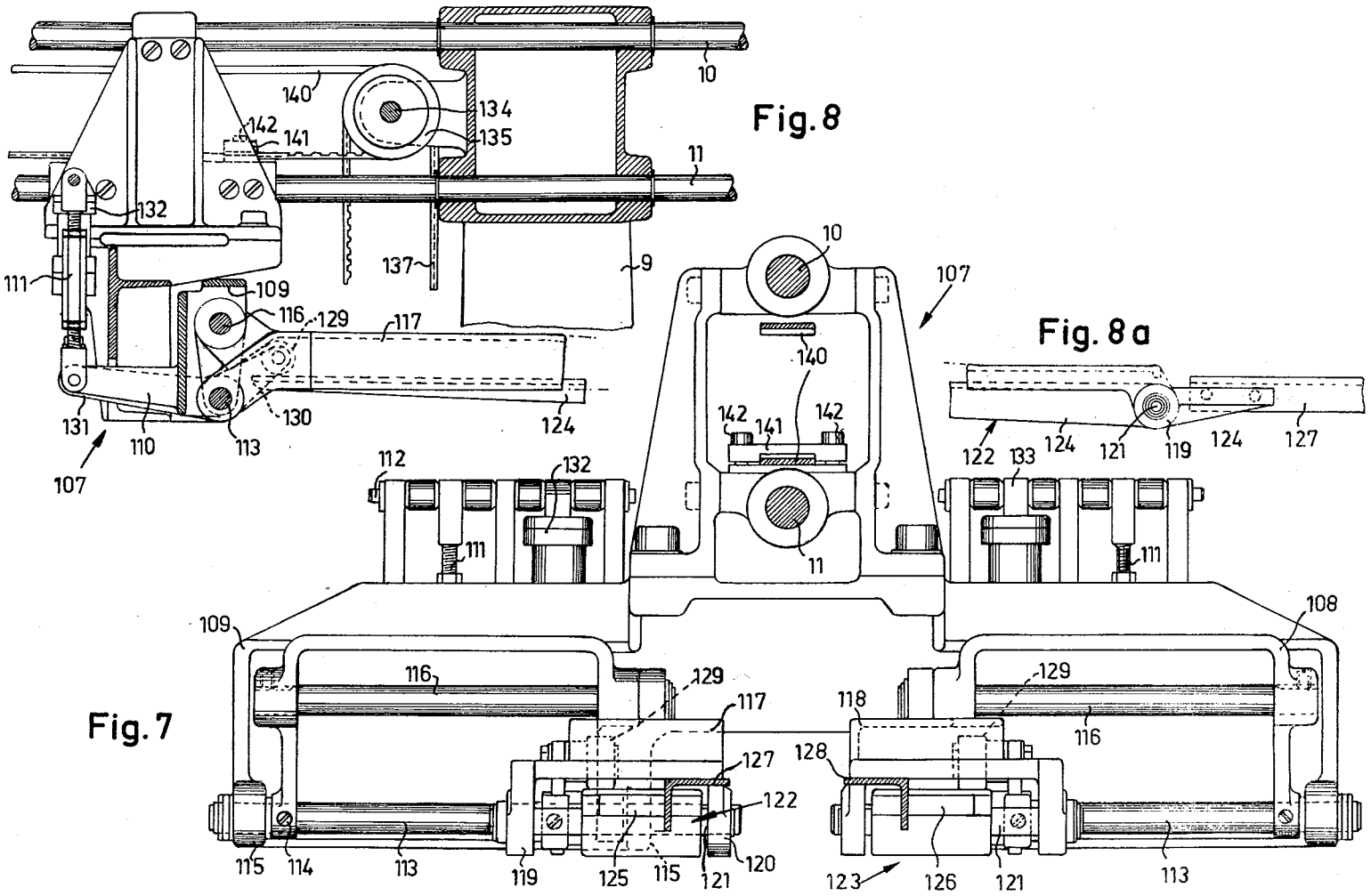
FIG. 7 is a section taken along line VII—VII of FIG. 1 together with the displacable supporting body.
FIG. 8 is a side elevation view of the displacable supporting body represented in FIG. 7.
FIG. 8*a* is a partial view of the jib located on the supporting body.
Figure 9:
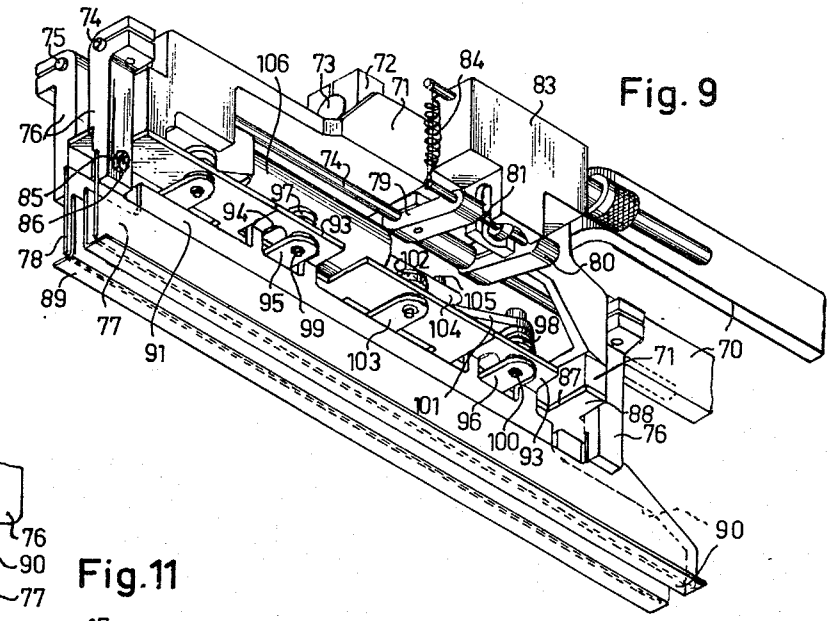
FIG. 9 is a perspective view of the folding device for the piping patch.
Figure 10:
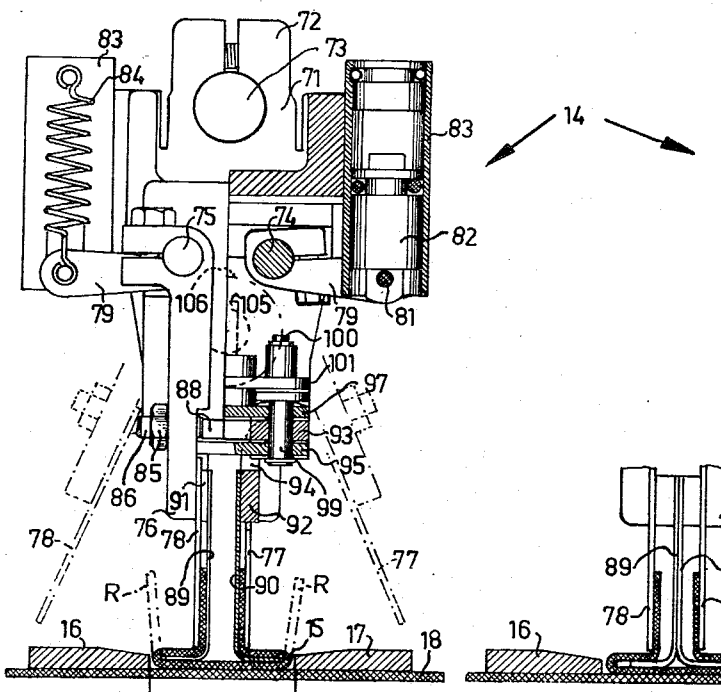
FIG. 10 is a front elevation, partly in section, showing the folding device.

As obvious from FIGS. 8 and 7, the arm 124 of the double armed lever 122 resp. 123 lies in the radius of action of a loose roller 129 supported to an angle lever 130, which is pivoted on the shaft 113. To its free arm 131 is hinged the piston rod of an air cylinder 132 respr. 133 arranged on the rod 112. The air cylinders 132 resp. 133 cause by means of the roller 129 a displacement of the double-armed lever 122 resp. 123.

Figure 19:
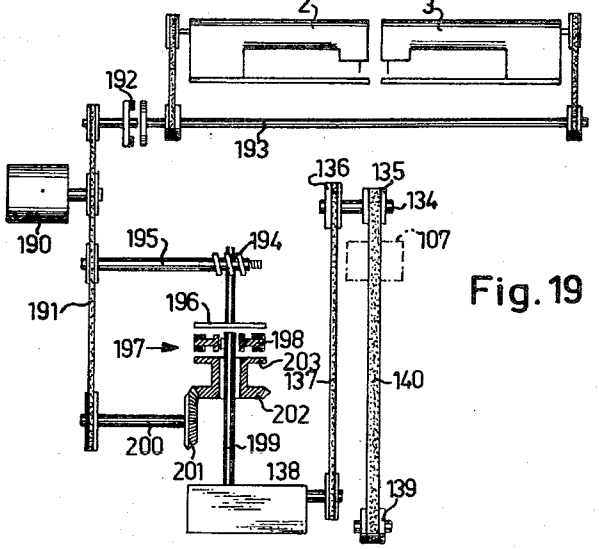
FIG. 19 is a diagrammatic representation of the driving and controlling means of the device.

Pivoted to the carrier 9 (FIGS. 1 and 8) is a shaft 134, to which are secured two toothed belt pulleys 135, 136 (diagrammatically represented in FIG. 19). The belt pulley 136 is in driving connection with a reversing gear 138 (FIG. 19) by means of a toothed belt 137, while a toothed belt 140 drives the belt pulley 135 and a further toothed belt pulley 139 pivoted at the carrier 8 (FIG. 1). The driving toothed belt 140 is clamped to the movable supporting body 107 by means of a clamping plate 141 (FIGS. 8 and 7) and screws 142.

The extension arms 127 and 128 carry a second workpiece clamp 143 (FIGS. 13 to 17) substantially comprising two homologous halves. Each workpiece clamp half has a pair of clamping rails 144 comprising a comb-shaped spring plate 146 having downwardly angled teeth 145, and a hold-down device 147 which is also formed like a comb and the teeth 148 of which are staggered with respect to the teeth 145 of the spring plate 146, so that they may be received in the gaps of the teeth of the spring plate.

Figure 15:
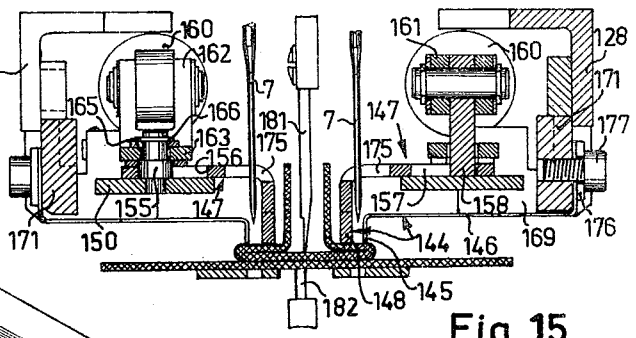
FIG. 15 is a section taken along line XV—XV of FIG. 14.
Figure 13:
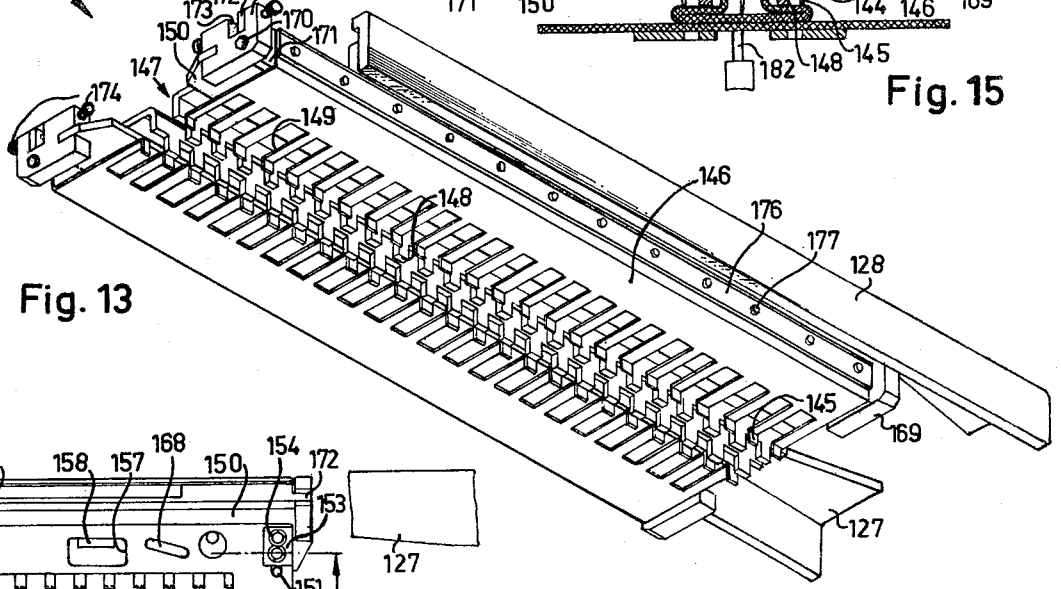
FIG. 13 is a perspective view of the second workpiece clamp.
Figure 14:
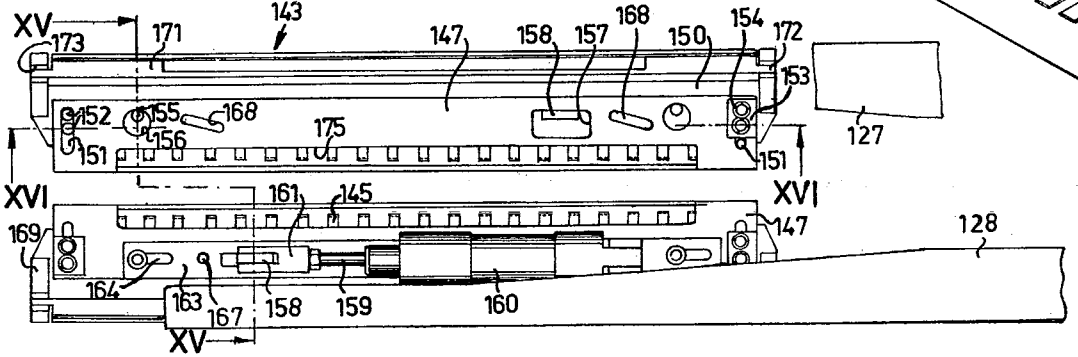
FIG. 14 is a top plan view of the second workpiece clamp, partly in section.

Each hold down device 147 is displacable in parallel with regard to the extension arms 127, 128 and for this purpose supported on a rail 150. The hold down device 147 is provided with oblongholes 151 in which engage two guide pins 152 inserted in the rail 150 and preventing by means of a plate 153 and tension rings 154 a lifting of the hold down device 147 from the rail 150. Displacability is limited by stop bolts 155 fixed in the rail 150, and a recess 156 in the hold down device 147 (FIGS. 14, 15). Furthermore, the hold down device 147 is formed with a recess 157 through which projects a plate 158. To this plate is hinged by means of a fork 161 a piston rod 159 of an air cylinder 160. The fixing end of the air cylinder 160 is received in a bearing block 162 connected to a further rail 163. The rail 163 displacable in oblong holes 164 above the hold down device, is received by the bolts 155 and secured by means of a disc 165 and retaining rings 166.

Figure 16:
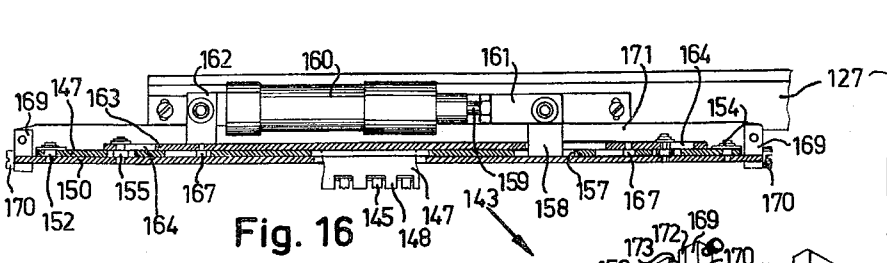
FIG. 16 is a section taken along line XVI—XVI of FIG. 14.

In the lower surface of the rail 163 are located two pins 167 (FIGS. 16) engaging in diagonally extending slots 168 formed in the hold down device 147. (FIGS. 14 and 16).

The rails 150 are provided with side parts 169 which are swingable about shoulder studs 170 and secured to a rail 171. The rail 171 is screwed to the extension arms 128 resp. 127 and formed on both ends with noses 172. (FIGS. 13 and 14) projecting into a recess 173 of the side parts 169. The hold down devices 147 may be adjusted with respect to the teeth 148 oppositely to the spring plates 146 by means of two adjusting screws 174 which are inserted in the side parts 169 and act upon the noses 172.

In the position represented in FIG. 15, the hold down devices 147 show a recess 175 for the passage of the sewing machine needles 7 between the spring plate 146 and the hold down devices 147. The spring plates 146 are connected to the rail 171 by means of a stiffening strip 176 and screws 177.

Figure 3:
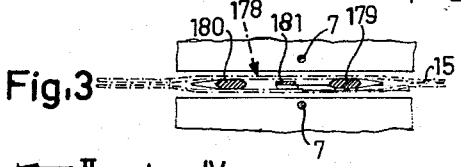
FIG. 3 is a sectional view of the spreader for the piping patch taken along line III—III of FIG. 1.

As obvious from FIGS. 1 and 3, a spreader 178 for the piping patch 15 is provided between the sewing machines 2, 3. The spreader 178 is secured to the carrier 9 and formed with a front 179 and a wedge-shaped rear spreader finger 180. Within a recess of the spreader 178 is located a cutting knife 181 (FIGS. 1 to 3 and 15) cooperating with a counterknife 182 in order to cut an elongated slit into the workpiece 18 and the piping patch 15 during sewing. The cutting knife 181 secured to double-armed lever 183 and pivoted to a plate, is driven by a motor by means of an eccentric 184, which imparts up and down motions to the cutting knife 181. By means of an air cylinder 185 the plate hinged to the carrier 9 and carrying the motor, may be turned in order to disengage the knives 181, 182.

Moreover, the device has two tab slit cutters 186, 187 operable by means of air cylinders 188, 189 in order to cut the two necessary diverging slits into the fabric layers after terminating the two parallel seams and the pocket slit. The tab slit cutter 189 is displacable and automatically controllable according to the different lengths of the pocket slits.

As obvious from FIG. 19, there is provided an electro motor 190 with positioning means for driving the device. For actuating the sewing machines 2, 3, the electromotor 190 drives a shaft 193 by means of a belt 191 and a disconnectable clutch 192. Furthermore, the belt 191 drives a shaft 195 which in turn drives a driving disc 196 of a reversing gear 197 in a reduced rate of revolutions by means of worm gear 194. A displacable clutch disk 198 is in driving connection with a driving shaft 199 for the reversing gear 138. Finally, the belt 191 drives a shaft 200, which drives in turn by means of bevel gears 201, 202 a driving disk 203. The driving disk 203 secured to the driving shaft 199 and connected to the bevel gear 202, is connectable to the clutch disk 198 of the reversing clutch 197 in order to drive the driving shaft 199 in an opposite direction.

Operation of the device can be described as follows, assuming, that the movable supporting body 107 (FIG. 1) is in a position adjacent to the toothed belt pulley 139 and the second workpiece clamp 143 is in the area of the tab slit cutters 186, 187.

By pressurizing the air cylinders 66, 34, 34' (FIGS. 4, 5) the first workpiece clamp 13 (FIG. 6) and the folding device 14 are lifted. The workpiece 18 is positioned below the workpiece clamp and aligned. Then, the clamp is lowered upon the workpiece 18. The piping patch 15 is positioned on the clamping plates 16 and 17. Then, the folding device 14 is lowered upon the piping patch 15 and brought into the free space "B" (FIGS. 10) between the two clamping plates 16 and 17. In doing so, at first the edges "R" of the piping patch 15 are deflected upwardly as dot-lined in FIG. 10. By pressurizing the air cylinder 83 located at the folding device 14, the folders 77, 78 are moved from the dot-lined position into the position drawn in full lines, thus forming the piping patch according to the shape of the center rails 89, 90.

In the case of sewing a pocket flap 61 together with a piping patch 15 to the workpiece 18, the pocket flap 61 is inserted in one of the two flap feeding devices 49 arranged on the clamping plates 16, 17. As obvious from FIG. 18, the pocket flap 61 rests on the driver 60 and the upper flap clamping plate 50. When pressurizing the air cylinder 54, the upper flap clamping plate 50 and alittle delayed also the lower flap clamping plate 52 are moved into the position dot-lined in FIG. 18, at which the edge of the flap 61 is bearing on the piping patch 15 and at the folders 77.

Figure 11:
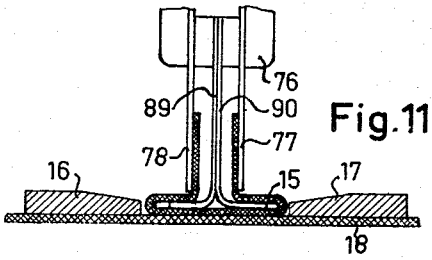
FIG. 11 is a partial view similar to FIG. 10 showing the center rails in a different position.
Figure 12:
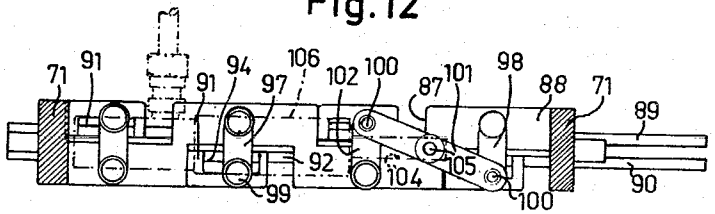
FIG. 12 is a section taken along line XII—XII of FIG. 10 through the folding device, in a reduced scale.

By pressurizing the air cylinders 106 (FIGS. 9, 10) the center rails 89, 90 are displaced in parallel to each other and are brought into the position shown in FIG. 11.

Now, the driving toothed belt 140 is moved by connecting the clutch disks 198 to the driving disks 203 and switching the motor 190 (FIG. 19). Simultaneously, the air cylinders 132, 133 are pressurized (FIGS. 7, 8, 8*a*) causing the lifting of the second workpiece clamp 143 about the axis 119 located in the jibs 117. In this lifted position, the second workpiece clamp 143 is moved through the recess "A" formed in the stationary supporting body 12 (FIG. 12), into the first workpiece clamp 13 and the folding device 14, as shown in FIG. 1.

Prior to the lowering of the second workpiece clamp 143 upon the piping patch 15, the air cylinders 160 are pressurized, causing that the teeth 148 of the hold down device 147 (FIG. 17) are removed out of the gaps of teeth 149 of the spring plates 146 and that, during lowering of the second workpiece clamp 143, the teeth 145 of the spring plates 146 project through the gaps of the comb-like formed upper flap clamping plate 50 and press the flap 61, the piping patch 15 and the workpiece 18, so that they are definitely clamped.

Subesquently, after pressurizing the air cylinder 35 (FIG. 6), the clamping plates 16, 17 of the first workpiece clamp 13 are removed from each other, so that the teeth of the upper flap clamping plates 50 are moved out of the gaps of teeth 149 of the spring plates 146.

After this, the driving shaft 199 is driven in an opposite direction by means of connecting the clutch disk 198 (FIG. 19) to the driving disk 196 and switching the motor 190, so that the movable supporting body 107 is moved, in order to feed the second workpiece clamp 143 with the clamped parts therein beneath the needles 7 of the sewing machines 2, 3. The sewing machines are switched on in a moment determined by a not further shown light barrier by means of the clutch 192. Now, the needles 7 may move up and down through the recess 175 betweenn the spring plates and the hold down devices 147, in order to sew the two parallel seams attaching the piping patch 15 and the flap 61 to the workpiece 18. At this, the hold down devices 147 prevent the fabric layers from being drawn upwardly by the upwardly moving needles 7.

After sewing predetermined number of stitches, the cutting knife 181 is switched on, in order to cut the pocket slit. It is switched off after having performed a predetermined slit length.

After performing the seams the sewing machines 2, 3 are disconnected. The needles remain in the upper position after the threads have been cut by a not futher shown thread cutter.

Figure 17:
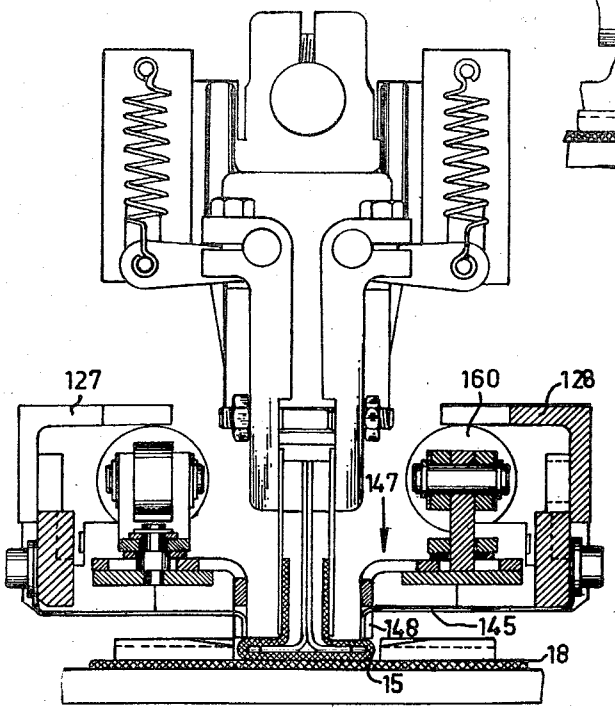
FIG. 17 is a view, partly in section, taken along line XVII—XVII XVLL of FIG. 1, in an enlarged scale.

Now, after the hold down devices 147 have been moved into the position shown in FIG. 17, the workpiece is fed into the area of the tab slit cutters 186, 187 (FIG. 1) in order to cut the diverging tab slits. After this, the second workpiece clamp 143 reaches its final position and is lifted by pressurizing the air cylinders 132 (FIG. 7) for removal of the workpiece 18, During sewing and the further procedures, the operator may insert the next following parts to be sewn into the first workpiece clamp 13, thus obtaining an overlapped method of operation.

What we claim is:

1. A device for producing piped openings in flat base material comprising a frame having a workplate, first workpiece clamping means including two clamping plates, for securing said flat base material to said workplate, piping patch holding and folding means, stationary stitching mechanisms for sewing said folded piping patch to said flat base material with two stitch rows, a straight slit forming means for cutting a slit into said flat base material and said piping patch during sewing, a cutting means for forming V-shaped tab-slits at the ends of said straight slit, driving and actuating means for said stitching mechanisms, said first workpiece clamping means, said piping patch holding and folding means and said cutting means, second workpiece clamping means having two pairs of clamping rails and displaceable into said first workpiece clamping means and said piping patch holding and folding means, to receive said flat base material together with said folded piping patch and to feed them through said stitching mechanisms and said cutting means, said piping patch holding and folding means comprising pocket flap delivery means attached to each of said clamping plates and cooperating with said second workpiece clamping means and said piping patch folding means for feeding a pocket flat into the area of said clamping rails of said second workpiece clamping means.

2. A device as claimed in claim 1, wherein said second workpiece clamping means is provided with two pairs of clamping rails which can be lowered upon said piping patch irrespectively from one another.

3. A device as claimed in claim 2, wherein each of said two pairs of clamping rails of said second workpiece clamping means consists of a comb-like spring plate having teeth which are bended downwardly, and a slidable comblike press pad having teeth receivable in the spaces of teeth of said spring plate.

4. A device as claimed in claim 3, wherein said press pads of said two pairs of clamping rails are provided with a recess for the passage of a sewing machine needle between said spring plate and said press pad.

5. A device as claimed in claim 1, wherein said first workpiece clamping means comprises two clamping plates for said first base material, lifting means for jacking up said clamping plates independently from one another, and shifting means working in opposite direction, for moving said plates in a parallel plane to said piping patch holding and folding means.

6. In a device as claimed in claim 1, wherein each of said pocket flap delivering means include an upper flap clamping plate pivoted to said clamping plates for said flat base material, a driving means connected with said upper flap clamping plate, a lower flap clamping plate pivoted about the axis of said upper flap clamping plate, and follower means secured to said upper flap clamping plate and cooperating with said lower flap clamping plate.

7. A device as claimed in claim 1, provided with second clamping means having a comb-like spring plate with downwardly bent teeth and wherein said upper flap clamping plate is formed with a comb-like toothed edge for receiving the teeth of said spring plate.

8. A device as claimed in claim 1, wherein said holding and folding means for said piping patches comprise two L-shaped center rails operating in a clearance between said clamping plates for said flat base material, two folders cooperating with said center rails, driving means to swivel said two folders and moving means for moving said center rails in a parallel plane at a right angle to the longitudinal axis of the device.

9. In a device as claimed in claim 1, wherein said second workpiece clamping means is provided with two pairs of clamping rails, a stationary supporting body carrying said first workpiece clamping means for said flat base material and said piping patch holding and folding means, carriers mounted on said frame, supporting rods received in said carriers and carrying said stationary supporting body, a slidable supporting body received on said supporting rods, two extension arms carrying said clamping rails and pivoted to said slidable supporting body, lifting means for lifting said extension arms and feeding means for moving said slidable supporting body on said supporting rods.

10. In a device as claimed in claim 1, wherein said stitching mechanism consists of two one-needle sewing machines for sewing two rows of stitches, means for changing the distances between the needles of said sewing machines.

11. In a device as claimed in claim 1, wherein said stitching mechanism includes two needles for sewing a folded piping patch to said flat base material with two stitch rows, a spreader arranged in a plate between said two needles and having a front spreader finger and a rear spreader finger for opening said folded piping patch during the transfer through said devices.

12. In a device as claimed in claim 1, wherein said stitching mechanism consists of two one needle sewing machines and said driving means for said sewing machines comprise a shaft in driving connection with said two sewing machines, and electro motor, a clutch coupling between said electro motor and said shaft, reversing gear means and reduction gear means driven by said electro motor and in driving connection with said second workpiece clamping means for moving said received flat base material together with said folded piping patch through said sewing machines with a reduced speed determining the stitch length and with an increased speed during the removing of said second workpiece clamping means into said first workpiece clamping means.

* * * * *